US006020907A

United States Patent [19]

Fassler et al.

[11] Patent Number: 6,020,907

[45] Date of Patent: Feb. 1, 2000

[54] SIMPLIFIED PRINTER DRIVE MECHANISM

[75] Inventors: Werner Fassler, Rochester; Charles D. DeBoer, Palmyra; James E. Pickering, Holcomb, all of N.Y.

[73] Assignee: Eastman Kodak Company, Rochester, N.Y.

[21] Appl. No.: 08/993,772

[22] Filed: Dec. 18, 1997

[51] Int. Cl.[7] ..... B41J 2/325

[52] U.S. Cl. ..... 347/218; 347/171

[58] Field of Search ..... 347/218, 171

[56] References Cited

U.S. PATENT DOCUMENTS

| | | | |
|---|---|---|---|
| 3,859,649 | 1/1975 | Slack | 340/675 |
| 4,101,018 | 7/1978 | Sokolowski | 347/104 |
| 4,312,007 | 1/1982 | Winfield | 347/14 |
| 4,745,413 | 5/1988 | Brownstein et al. | 347/182 |
| 4,752,786 | 6/1988 | Inoue et al. | 346/139 R |
| 4,953,994 | 9/1990 | Shiozaki et al. | 400/120.16 |
| 5,266,976 | 11/1993 | Ohigashi et al. | 347/116 |
| 5,666,598 | 9/1997 | Sugita et al. | 399/136 |
| 5,668,585 | 9/1997 | Brechko | 347/220 |
| 5,677,722 | 10/1997 | Park | 347/218 |
| 5,774,777 | 6/1998 | Ohtsuka et al. | 399/384 |
| 5,807,000 | 9/1998 | Kawamura et al. | 347/174 |

*Primary Examiner*—N. Le
*Assistant Examiner*—Shih-Wen Hsieh
*Attorney, Agent, or Firm*—Raymond L. Owens

[57] ABSTRACT

A printer for transferring colorant from a donor web to a receiver web, includes a rotatable platen roller and a printhead having an energy transfer portion engaging the donor web and pressing the donor web into engagement with the receiver web and the receiver web into the surface of the rotatable platen roller to form a nip so that as the rotatable platen rotates, both the receiver web and the donor web are translated. Applied energy to the printhead is transferred from the energy transfer portion of the printhead to the donor web to transfer colorant to the receiver web at the nip. The movement of the receiver web is sensed for controlling the rotation of the rotatable platen roller and energy application.

4 Claims, 4 Drawing Sheets

SIMPLIFIED PRINTER DRIVE MECHANISM

FIELD OF THE INVENTION

The present invention relates to printers which cause the transfer of colorant from a donor web to a receiver web.

BACKGROUND OF THE INVENTION

One type of printer which transfers colorant from a donor web to a receiver web is a thermal printer that uses a dye transfer process.

U.S. Pat. No. 5,266,976 describes an apparatus for multipass color electrostatic recording in which edge registration marks are printed on the edge of the print on the first pass and then read by a sensor on subsequent passes to register the colors in the final print. The apparatus is illustrated by a belt drive devise, and may be limited to a continuous web, and a latent image process. The printed registration marks may be objectionable in many kinds of printed images.

U.S. Pat. No. 4,745,413 describes a thermal head printing apparatus, but no method of correction for registration is given.

U.S. Pat. No. 4,953,994 describes a thermal printer which has a control apparatus to locate printing on a label. With this arrangement, mulitpass registration is a problem.

U.S. Pat. No. 4,752,786 describes a thermal printer with a simplified drive mechanism using a single motor for all drive functions.

SUMMARY OF THE INVENTION

It is an object of the present invention to provide a simplified printer which effectively can transport a donor web and a receiver web through a nip wherein colorant is transferred from the donor web to the receiver web.

Another object of the present invention is to provide a printer which translates the donor web and receiver web and does not need to use a complex capstan drive system.

These objects are achieved by a printer for transferring colorant from a donor web to a receiver web, comprising:

a) a rotatable platen roller;

b) a printhead having an energy transfer portion engaging the donor web and pressing the donor web into engagement with the receiver web and the receiver web into the surface of the rotatable platen roller to form a nip so that as the rotatable platen rotates, both the receiver web and the donor web are translated;

c) means for applying energy to the printhead which is transferred from the energy transfer portion of the printhead to the donor web to transfer colorant to the receiver web at the nip; and d) means for sensing the movement of the receiver web for controlling the rotation of the rotatable platen roller and the energy applying means.

ADVANTAGES

An advantage of this invention is that registration of the different colors is precise and accurate.

Another advantage is that the transport arrangements for the donor web and receiver web is particularly effective for multipass registration situations.

DETAILED DESCRIPTION OF THE INVENTION

The invention has been described in detail with particular reference to certain preferred embodiments thereof, but it will be understood that variations and modifications can be effected within the spirit and scope of the invention to elements forming part of, or cooperating more directly with, apparatus and method in accordance with the present invention. It is to be understood that elements not specifically shown or described may take various forms well known to those skilled in the art.

The receiver web used in this invention should be understood to refer in general to all types of receiver materials, including conventional papers made from wood pulp, synthetic papers made from polymer fibers and extruded plastics films.

Figure 1:
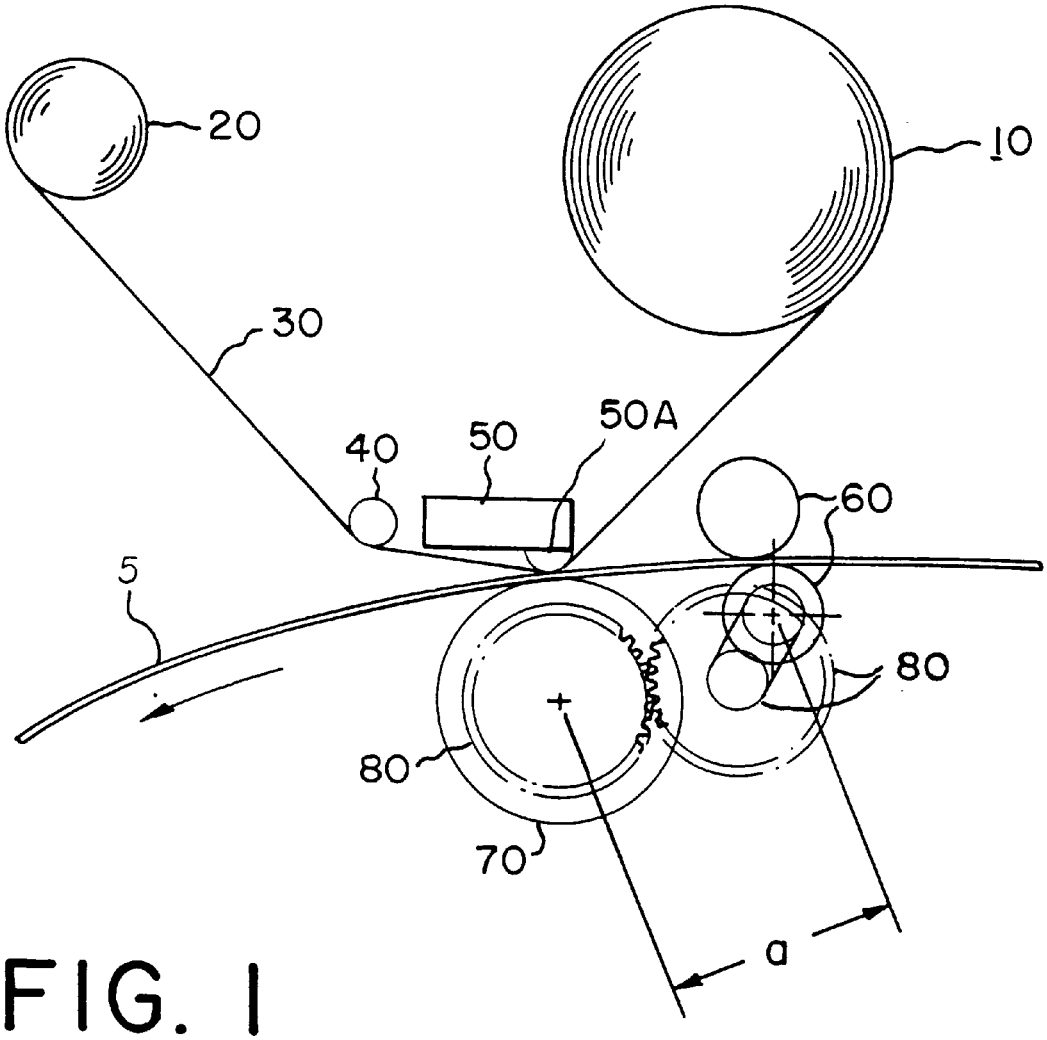
FIG. 1 (PRIOR ART)
FIG. 1 is a schematic diagram of a prior art capstan drive printer.

FIG. 1 shows a prior art capstan drive printer commonly used in thermal resistive head printers. In this kind of printer, a donor web 30 is transported past a thermal resistive print head 50 from a donor supply roll 10 to a donor take-up roll 20. A guide roller 40 is used to steer the donor web 30. The donor web 30 contacts the receiver web 5 at the energy transfer portion of the print head 50A, thus pressing the donor web 30 against the receiver web 5 and thereby forming a nip where the energy applied to the print head will effect transfer of colorant from the donor web to the receiver web without blank spots or drop-outs. A pair of capstan rollers 60 geared to the platen drive roller 70 serve to drive the receiver web across the print heat 50, and the nip pressure caused by the energy transfer portion of the print head 50A pressing the donor web 30 into the receiver web 5 and the receiver web 5 in turn into the platen drive roller 70 serves to move the donor web 30 along with the receiver web 5 in the direction of the arrow in FIG. 1. The materials used to form the capstan rollers 60 and the capstan drive mechanism 80 that connect the capstan rollers to the platen drive roller 70 must be manufactured with high precision tolerances to prevent slippage of the donor and to prevent positional error banding in the printed image. In addition, the distance "a" indicated in FIG. 1, which is necessarily of a significant size, requires an unprinted border at the edge of the printed image so that contact of the receiver web with the capstan rollers is maintained through the printing process.

Figure 2:
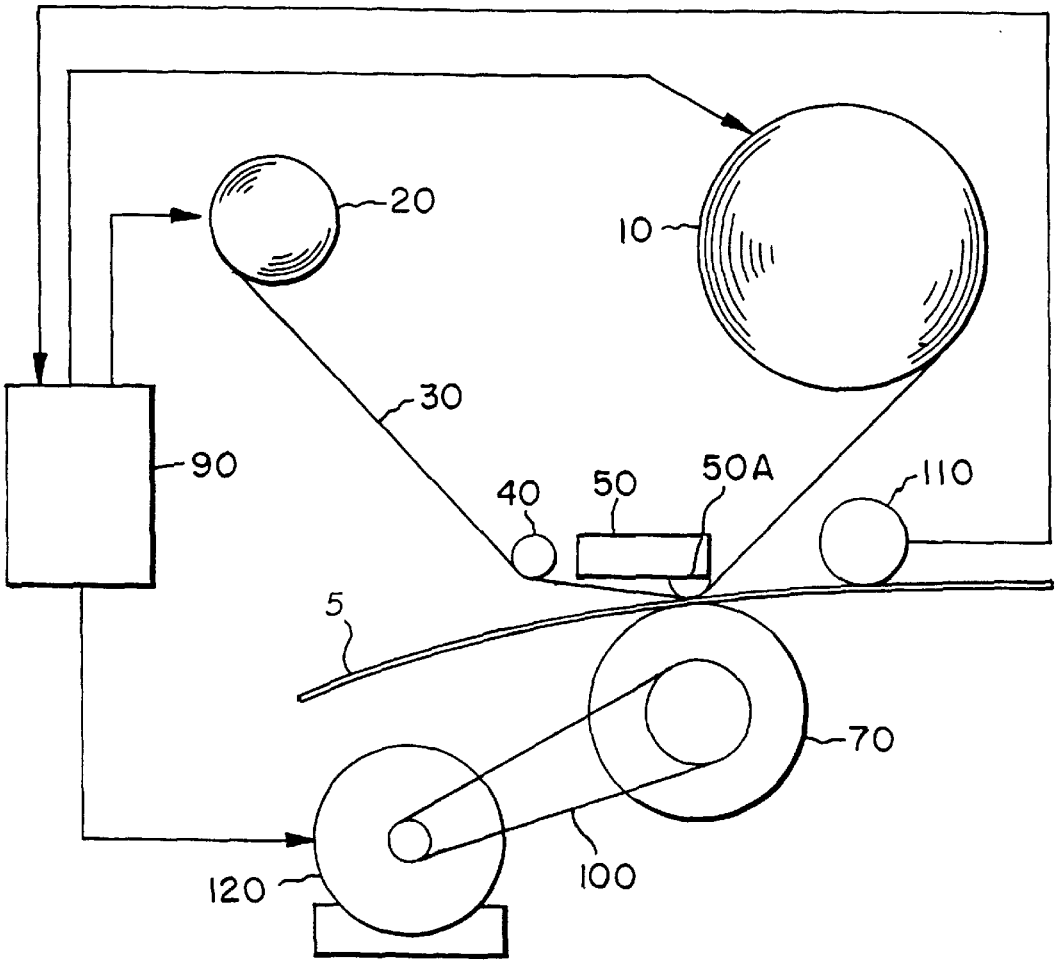
FIG. 2 shows a simplified platen drive printer in accordance with the present invention.

FIG. 2 shows the simplified and improved mechanism of this invention. A donor web 30 is transported past a thermal resistive print head 50 from a donor supply roll 10 to a donor take-up roll 20. A guide roller 40 is used to steer the donor web 30. The donor web 30 contacts the receiver web 5 at the energy transfer portion 50A of the print head 50, thus pressing the donor web 30 against the receiver web 5 and thereby pressing the receiver web onto the surface of the rotatable platen roller 70, thus forming a nip, so that rotation of the platen roller 70 urges both the donor and the receiver webs forward in the direction of the arrow in FIG. 1. Preferably, the rotatable platen roller 70 is incrementally rotated under the control of computer 90 (see FIG. 2). The pressure of the nip guarantees good contact between the donor and receiver so that the energy applied to the print head will effect transfer of colorant from the donor web to the receiver web without blank spots or drop-outs. A receiver web movement sensor 110 (which can be an encoder) monitors the position and movement of the receiver web. The sensor is connected to a computer 90 which sends electrical signals to the platen drive motor 120 and to the energized part of the print head 50 so that the incremental rotation of the rotatable platen roller may be controlled to move the receiver web into a position synchronized with the application of energy from the print head 50 so that the different colors of a full color image may be transferred in accurate positional association, sometimes referred to as "in registration". The receiver web movement sensor 110 may take any one of several forms. A simple encoding wheel driven by the movement of the receiver web may be used to monitor the position of the receiver web. Alternatively, a non contact sensor utilizing a light signal or an electrical capacitance signal may be devised.

Figure 3:
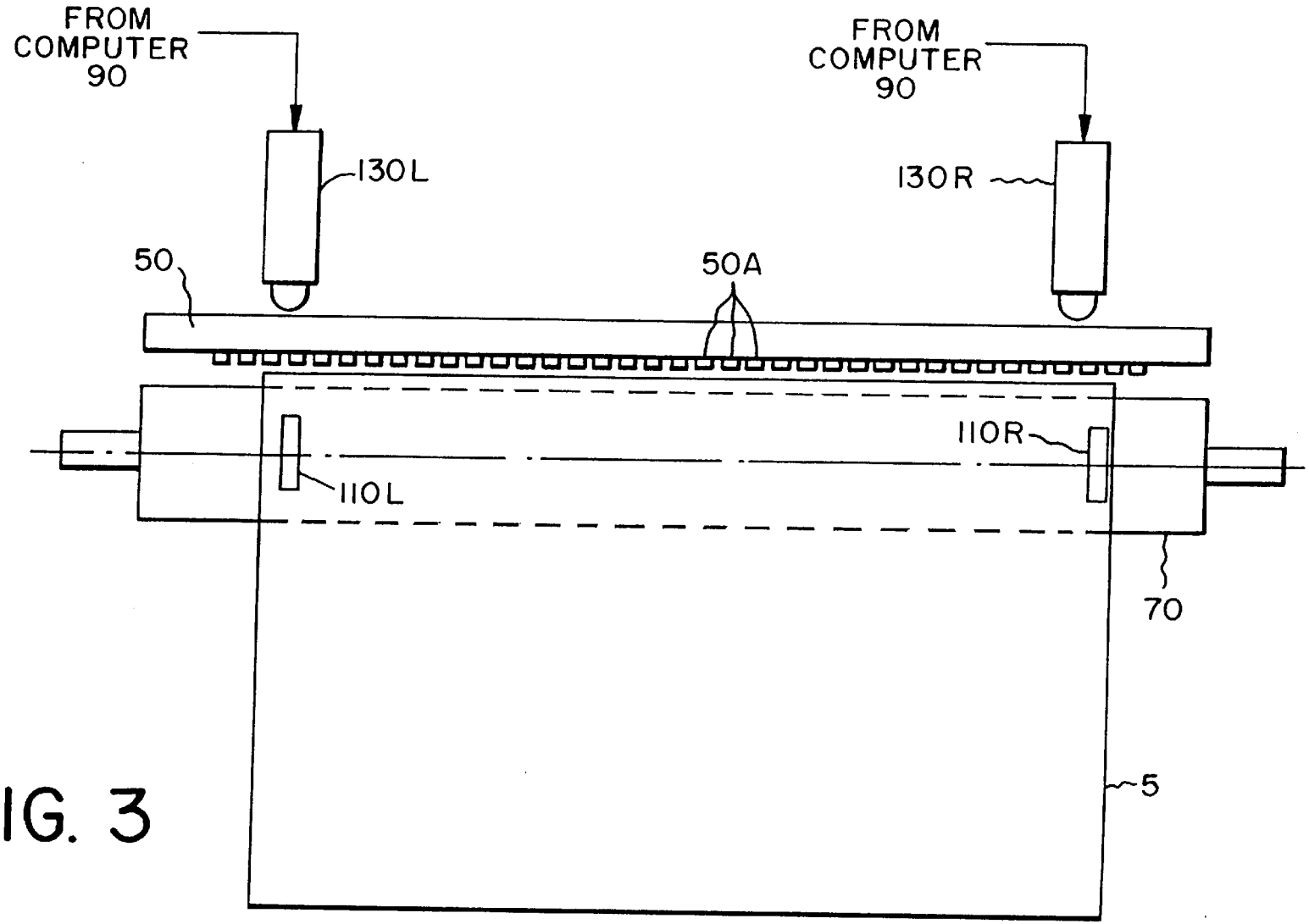
FIG. 3 shows a left to right view of the print head and the skew correction mechanism of FIG. 2.

FIG. 3 shows a view of the print head 50 and platen roller 70 across the receiver web 5. The donor web 30 is omitted from this drawing for clarity. Both a right hand 110R and left hand 110L receiver web movement sensor are shown. Signals from these two sensors are communicated to the computer 90 which can thereby detect a skew in alignment of the receiver web 5 with the print head 50. The two head position controllers 130 receive signals from the computer 90 to control the position of the print head 50 in a direction normal to the rotatable platen roller 70. By controlling the position of the print head the pressure of the nip between the donor web and the receiver web may be increased or decreased thus causing more or less slippage of the receiver web 5 against the rotatable platen roller 70 so that skew errors in the receiver motion may be corrected.

Figure 4:
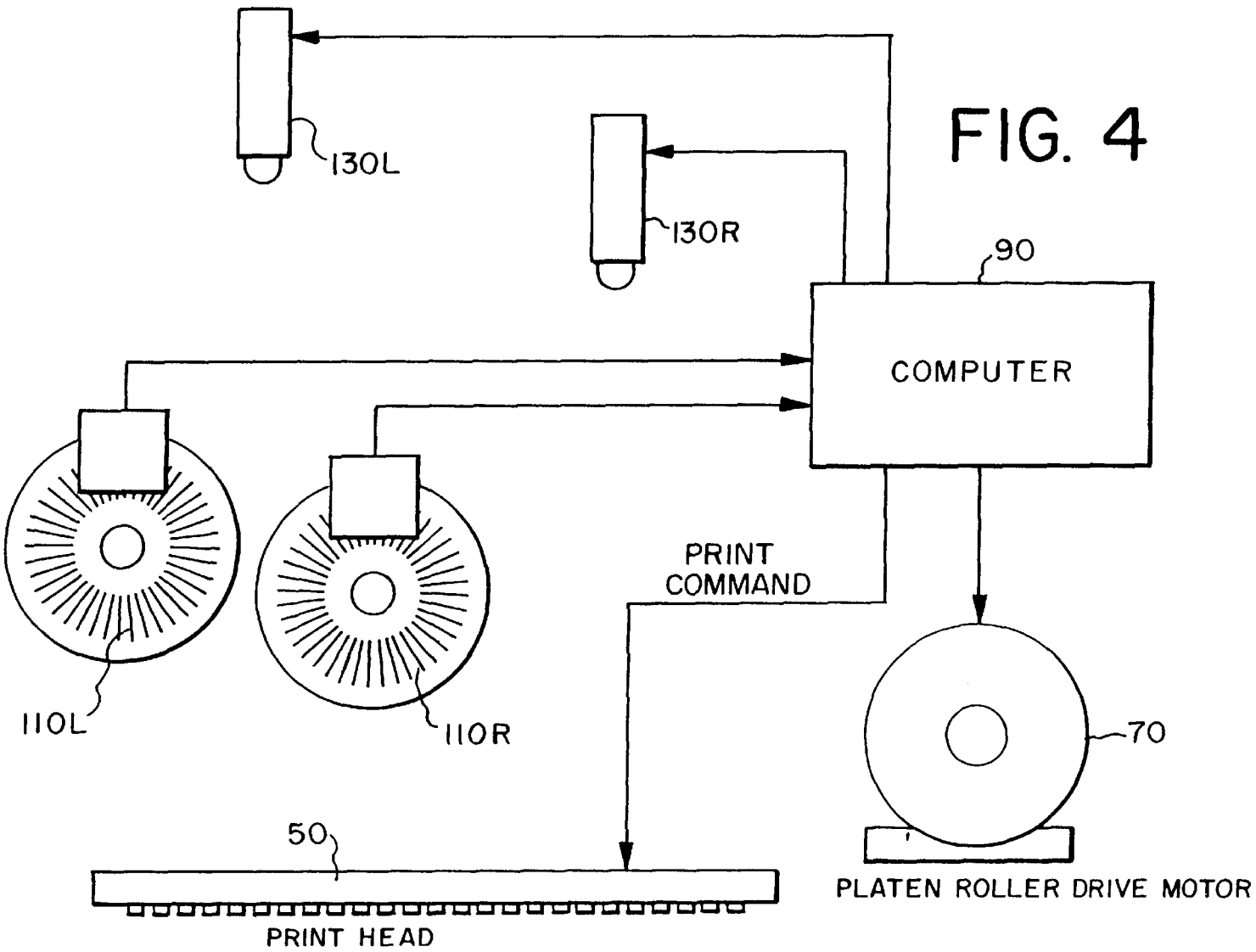
FIG. 4 shows a control diagram of a computer, sensors, and a head position controller which control the printer.

FIG. 4 is a drawing showing how the computer 90 receives a digital image from memory, and receives signals from the right hand receiver web movement sensor 110R and the left hand receiver web movement sensor 110L, and sends corresponding signals to the right and left hand head position controllers 130, to the print head 50, and to the belt drive 100 of the rotatable platen roller 70. The energizing signals to the print head are sent when the receiver web movement sensors determine that the receiver web 5 is in the correct position for colorant transfer from the donor web 30 to the receiver web 5.

The invention has been described in detail with particular reference to certain preferred embodiments thereof, but it will be understood that variations and modifications can be effected within the spirit and scope of the invention.

PARTS LIST

5 receiver web
10 donor supply roll
20 spent donor take-up roll
30 donor web
40 guide roller
50 print head
60 capstan rollers
70 rotatable platen roller
80 capstan drive mechanism
90 computer
100 belt drive
110 receiver web movement sensor
120 platen drive motor
130 head position controller

What is claimed is:

1. A printer for transferring colorant from a donor web to a receiver web, comprising:

a) a rotatable platen roller;

b) a printhead having an energy transfer portion engaging the donor web and pressing the donor web into engagement with the receiver web and the receiver web into the surface of the rotatable platen roller to form a nip so that as the rotatable platen rotates, both the receiver web and the donor web are translated;

c) means for applying energy to the printhead which is transferred from the energy transfer portion of the printhead to the donor web to transfer colorant to the receiver web at the nip;

d) means for sensing the movement of the receiver web for controlling the rotation of the rotatable platen roller and the energy applying means;

e) means for sensing the position of the receiver web; and f) means including two spaced apart controllers responsive to the receiver web position sensing means for adjusting the pressure at different positions of the print head on the printhead to control the pressure along the nip to change the slippage of the receiver against the rotatable platen to correct for skew errors of the receiver entering the nip.

2. The printer of claim 1 wherein the donor web includes a colorant which is transferable in response to heat and wherein the printhead applies heat to the donor web at the nip.

3. The printer of claim 1 further including a platen drive motor that incrementally rotates the rotatable platen roller.

4. The printer of claim 3 further including an encoder for producing electrical signals representing the motion of the receiver web and means responsive to such signals to control the platen drive motor.

* * * * *